US005877692A

United States Patent [19]

Watanabe et al.

[11] Patent Number: 5,877,692

[45] Date of Patent: Mar. 2, 1999

[54] PART LIFE DETECTION AND DISPLAY UNIT

[75] Inventors: Toshio Watanabe; Hideyasu Nakamura, both of Ebina, Japan

[73] Assignee: Fuji Xerox Corporation, Tokyo, Japan

[21] Appl. No.: 755,361

[22] Filed: Nov. 25, 1996

[30] Foreign Application Priority Data

Nov. 28, 1995 [JP] Japan ..... 7-309021

[51] Int. Cl.[6] ..... G08B 21/00

[52] U.S. Cl. ..... 340/679; 340/457.4; 399/25

[58] Field of Search ..... 340/679, 457.4; 399/24, 25, 26, 111, 113

[56] References Cited

U.S. PATENT DOCUMENTS

| | | | |
|---|---|---|---|
| 4,860,052 | 8/1989 | Ito et al. | 399/24 |
| 5,017,962 | 5/1991 | Tsuji et al. | 399/24 |
| 5,051,778 | 9/1991 | Watanabe et al. | 399/25 |
| 5,066,978 | 11/1991 | Watarai et al. | 399/24 |
| 5,196,884 | 3/1993 | Sugiyama et al. | 399/24 |
| 5,206,685 | 4/1993 | Hara et al. | 399/24 |
| 5,546,163 | 8/1996 | Asai et al. | 399/11 |

FOREIGN PATENT DOCUMENTS

| | | |
|---|---|---|
| 62-36217 | 8/1987 | Japan . |

*Primary Examiner*—Nina Tong
*Attorney, Agent, or Firm*—Oliff & Berridge, PLC

[57] ABSTRACT

In a part life detection and display unit, the life of each periodically replaced part is detected and displayed separately based on the life alarm value and in addition, the part lives are detected and displayed in units of periodically replaced part groups each consisting of parts that are almost the same in life term value and can be replaced in batch at the same time, and all parts in the part group containing the part reaching the life alarm value are replaced at the same time.

3 Claims, 8 Drawing Sheets

Ⓐ : REPLACEMENT PROMPTING DESPLAY OF PACKAGE A

Ⓑ : REPLACEMENT PROMPTING DESPLAY OF PACKAGE B

Ⓒ : REPLACEMENT PROMPTING DESPLAY OF PACKAGE C

FIG. 3

| PACKAGE | ID CODE OF PERIODICALLY REPLACED PART | CURRENT LIFE | SPEC LIFE |
|---|---|---|---|
| A | 001 | 150 (K REVOLUTIONS) | 200 (K REVOLUTIONS) |
| | 002 | 60 (HOURS) | 80 (HOURS) |
| | 003 | ---------- | 80 (HOURS) |
| | 004 | ---------- | 80 (HOURS) |
| | 006 | ---------- | 80 (HOURS) |
| | 007 | ---------- | 80 (HOURS) |
| | 008 | ---------- | 80 (HOURS) |
| | 010 | ---------- | 160 (HOURS) |
| | 013 | ---------- | 80 (HOURS) |
| | 014 | ---------- | 80 (HOURS) |
| | 017 | ---------- | 25 (K COPIES) |
| B | 005 | 70 (K REVOLUTIONS) | 100 (K REVOLUTIONS) |
| | 009 | 90 (K REVOLUTIONS) | 200 (K REVOLUTIONS) |
| | 011 | ---------- | 400 (K REVOLUTIONS) |
| | 012 | ---------- | 400 (K REVOLUTIONS) |
| | 018 | ---------- | 50 (K COPIES) |
| C | 015 | 65 (HOURS) EACH | 100 (HOURS) EACH |
| | 016 | 70 (K COPIES) | 100 (K COPIES) |
| | 019 | ---------- | 100 (K COPIES) |
| | 020 | ---------- | 500 (K REVOLUTIONS) |
| D | 021 | 210 (K COPIES) | 300 (K COPIES) |

Ⓐ : REPLACEMENT PROMPTING DESPLAY OF PACKAGE A

Ⓑ : REPLACEMENT PROMPTING DESPLAY OF PACKAGE B

Ⓒ : REPLACEMENT PROMPTING DESPLAY OF PACKAGE C

FIG. 7

| PACKAGE | PART ID CODE | CURRENT LIFE | SPEC LIFE |
|---|---|---|---|
| A | 001 | 150 (K REVOLUTIONS) | 200 (K REVOLUTIONS) |
| | 002 | 60 (HOURS) | 80 (HOURS) |
| | ⋮ | ⋮ | ⋮ |
| | 017 | 20 (K COPIES) | 25 (K COPIES) |
| B | ⋮ | ⋮ | ⋮ |
| | 009 | 90 (K REVOLUTIONS) | 200 (K REVOLUTIONS) |
| | ⋮ | ⋮ | ⋮ |
| | 018 | 40 (K COPIES) | 50 (K COPIES) |
| C | 015 | 60 (HOURS) | 100 (HOURS) |
| | ⋮ | ⋮ | ⋮ |

L

FIG. 8

| PACKAGE | PART ID CODE | CURRENT LIFE | SPEC LIFE |
|---|---|---|---|
| A | 001 | | |
| | 002 | | |
| | ⋮ | ⋮ | ⋮ |
| B | | | |
| | 009 | 200 | 200 |
| | ⋮ | ⋮ | ⋮ |
| | 018 | | |
| C | 015 | | |
| | ⋮ | ⋮ | ⋮ |

,---- BLINK DISPLAY

FIG. 9

| PACKAGE | PART ID CODE | CURRENT LIFE | SPEC LIFE |
|---|---|---|---|
| A | 001 | | |
| | 002 | 80 | 80 |
| | ⋮ | ⋮ | ⋮ |
| B | | | |
| | 009 | 220 | 200 |
| | ⋮ | ⋮ | ⋮ |
| | 018 | 50 | 50 |
| C | 015 | | |
| | ⋮ | ⋮ | ⋮ |

---- BLINK DISPLAY

PART LIFE DETECTION AND DISPLAY UNIT

BACKGROUND OF THE INVENTION

1. Field of the Invention

This invention relates to a part life detection and display unit for detecting and displaying the lives of a large number of periodically replaced parts used in image formation systems such as color copiers and color printers.

2. Description of the Related Art

A large number of periodically replaced parts such as photosensitive drums, corotron wires, and developers are used in color copiers, etc. To detect and display the lives of such periodically replaced parts, for example, a detection and display system is employed wherein the use results of the periodically replaced parts are measured based on indexes such as the number of copies, the part operation time, and the number of times the part has been operated for each part and when the measured cumulative value reaches a replacement alarm value preset based on the indexes, the part is assumed to reach "part life" and a replacement message for prompting the operator to replace the part is displayed.

However, since such a part life detection and display system manages the life of each periodically replaced part by measuring each index, the arrival time until the measured cumulative value reaches the replacement alarm value also varies from one part to another. Resultantly, parts reach their respective replacement alarm values one after another at one time and must be replaced each time in a short time. Such a circumstance tends to occur more remarkably in color copiers.

Thus, replacement work of servicepersons, etc., becomes intricate and the work efficiency extremely worsens because of repeated part replacement in a short time. Moreover, if a large number of parts different in attachment place must be replaced at a time, management of the parts to be replaced and work are placed out of order, replacement of some parts is forgotten because of some mistake, and use of the unreplaced parts in a state in which their replacement alarm values are exceeded will lead to a failure.

A system similar to the detection and display system is a system wherein the use results and replacement alarm values of periodically replaced parts are all measured and set in terms of the same index and when the measured cumulative value reaches the replacement alarm value in terms of the index, a replacement message is displayed. For example, a part life detection and display unit with the number of copies applied as the index for the purpose is disclosed in Japanese Patent Examined Publication No. Sho 62-36217.

However, the part life detection and display system using term values based on such a common index provides a simple configuration because the number of index measurement objects for managing the part lives is small. In contrast, it involves the following problem:

The arrival time of each periodically replaced part by the time the term value reaches a replacement alarm value often varies widely from one part to another depending on the use mode of a copier, etc., such as the use ratio between color and monochrome copies or the number of continuous copies from a 1-sheet original document). Thus, the arrival time by the time the cumulative value measuring the index for conversion reaches a replacement alarm value also varies widely from one part to another. Resultantly, problems of bad work efficiency of part replacement, forgetting to replace parts, etc., as described above still arise.

SUMMARY OF THE INVENTION

It is therefore an object of the invention to provide a part life detection and display unit which enables easy life management of a large number of periodically replaced parts and moreover enables more efficient and reliable replacement work of the parts to be replaced.

To the end, according to the invention, there is provided a part life detection and display unit comprising measurement means for measuring and accumulating use results of a large number of periodically replaced parts in an image formation system based on indexes appropriate for the parts, means for displaying predetermined information, detection and display control means for comparing each cumulative value of the measurement means with a life alarm value preset based on each index for each periodically replaced part and instructing the display means to display replacement prompting indication of the periodically replaced part reaching its life alarm value, and reset means, upon completion of replacement of the periodically replaced part whose cumulative value reaching its life alarm value, being capable of resetting the cumulative value of the measurement means related to the part to zero, characterized in that the periodically replaced parts are classified into part groups each consisting of parts that can be replaced at least in batch at the same time and can be sorted according to life term values in terms based on a single index and each of life term values of part groups other than the part group having the shortest life term value among the part groups is set to an integer multiple of the life term value of the part group having the shortest life term value, and that the detection and display control means detects a periodically replaced part in each part group reaching its life alarm value and if the periodically replaced part reaching its life alarm value exists in the part group having the shortest life term value, compares the number of times the part group having the shortest life term value is replaced with a value of the integer multiple of the life term value of the part group having the shortest life term value relative to each of the life term values of other part groups (where the life term value of the part group having the shortest life term value is assumed to be one) and when the number of times the part group having the shortest life term value is replaced does not match any values of the integer multiples, displays replacement prompting indication of the part group having the shortest life term value. When the number of times the part group having the shortest life term value is replaced matches the value of the integer multiple, replacement prompting indications of the part group having the shortest life term value and the part group corresponding to the value of the integer multiple matched are displayed at the same time. On the other hand, if the periodically replaced part reaching its life alarm value exists in any other part group than the part group having the shortest life term value, replacement prompting indications of the part group containing the part reaching the life alarm value and the part group having the life term value set shorter than that of that part group are displayed at the same time.

The invention assumes that a large number of periodically replaced parts are classified into part groups and that life guidelines of the part groups are set so that they have integer multiple relationships with each other. That is, the periodically replaced parts are classified into part groups each consisting of parts that can be replaced at least in batch at the same time and can be sorted according to life term values in terms based on the same index. The life guidelines of the part groups are set so that the life term value of the part group having the shortest life term value has integer multiple relationship with the life term values of other part groups, such as two, three, four, . . . , (where the life term value of the part group having the shortest life term value is assumed to be one).

The invention basically assumes that if one of the periodically replaced parts in the part groups reaches its replacement alarm value, replacement prompting indication of the part group containing the part is displayed and all parts in the part group are replaced in batch although other periodically replaced parts than the part do not yet reach their life alarm values at the point in time.

Based on the basic principles, for management concerning the lives of the part groups (detection and display), the number of times the part group having the shortest life term value is replaced is compared with the value of the integer multiple of the life term value of the part group having the shortest life term value relative to each of the life term values of other part groups (where the life term value of the part group having the shortest life term value is assumed to be one), and replacement prompting indication for predetermined part groups is displayed based on the comparison result.

That is, if the part reaching its replacement alarm value exists in the part group having the shortest life term value, when the number of times the part group having the shortest life term value is replaced does not match any values of the integer multiples, replacement prompting indication of the part group having the shortest life term value is displayed; when they match, replacement prompting indications of the part group having the shortest life term value and the part group corresponding to the value of the integer multiple matched are displayed at the same time. If the part reaching its life alarm value exists in any other part group than the part group having the shortest life term value, replacement prompting indications of the part group containing the part and the part group having the life term value set shorter than that of that part group are displayed at the same time.

The above and other objects and features of the present invention will be more apparent from the following description taken in conjunction with the accompanying drawings.

BRIEF DESCRIPTION OF THE DRAWINGS

In the accompanying drawings:

FIG. 3 is a table listing the types of part groups (packages) classified in the detection and display unit and life alarm values;

FIG. 7 is an illustration showing the display contents of a control panel;

FIG. 8 is an illustration showing one example of the display operation of the control panel; and FIG. 9 is an illustration showing another example of the display operation of the control panel.

DETAILED DESCRIPTION OF THE PREFERRED EMBODIMENTS

A description will be given in more detail of preferred embodiments of the present invention with reference to the accompanying drawings.

Figure 1:
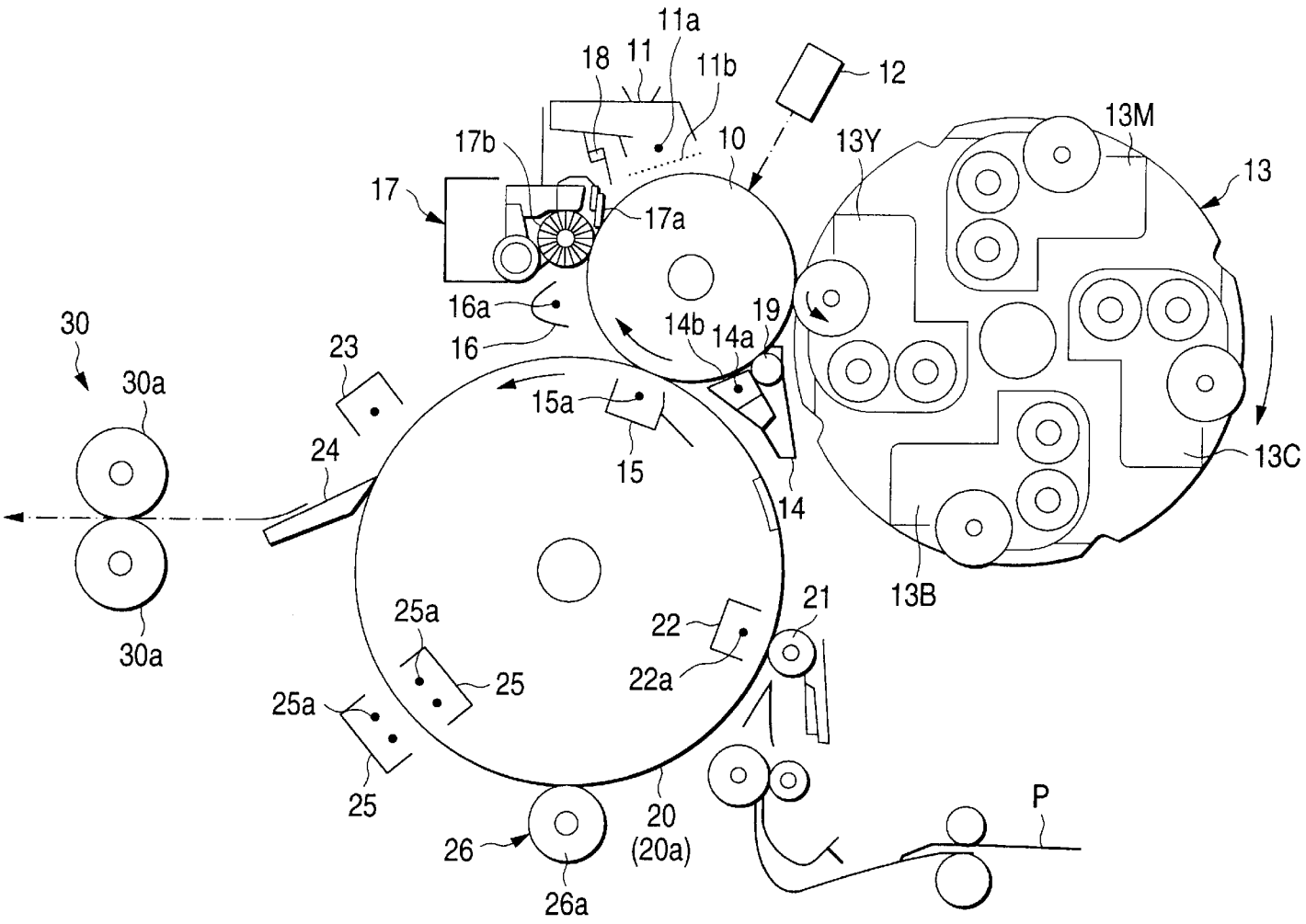
FIG. 1 is a conceptual diagram showing the main part to show one embodiment of a color copier to which the invention is applied.

FIG. 1 is a conceptual diagram showing the main part to show one embodiment of a color copier to which the invention is applied.

In FIG l, reference numeral 10 denotes a photosensitive drum adapted to rotate in the arrow direction using an organic semiconductor. The photosensitive drum 10 is surrounded by a charge corotron 11, an image exposure device 12, a rotary developing unit 13, a transfer auxiliary corotron 14, a transfer corotron 15, an electricity removal corotron 16, a cleaning unit 17, an electricity removal lamp 18, etc. Reference numeral 20 denotes a transfer drum being disposed so as to face a transfer section of the photosensitive drum 10 and rotating in the arrow direction at the same speed as the photosensitive drum 10. The transfer drum 20 is a drum around which a dielectric film 20*a* is wrapped. A paper attraction roll 21, a paper attraction corotron 22, a paper stripping-off corotron 23, a paper stripping-off claw 24, an electricity removal corotron 25 of the dielectric film 20*a,* a cleaning unit 26 of the dielectric film 20*a,* and the like are disposed on the outer and inner peripheral sides of the transfer drum 20. Further, reference numeral 30 denotes a fuser and P is a sheet of recording paper.

The parts and their functions are outlined as follows:

The charge corotron 11, which comprises a discharge wire 11*a* and a grid 11*b,* uniformly charges the surface of the photosensitive drum 10 rotating in the arrow direction. The image exposure device 12, which comprises a light source such as a semiconductor laser, irradiates the surface of the photosensitive drum 10 from the light source with a light beam responsive to image information from an original document reader (not shown) for forming an electrostatic latent image. The original document reader comprises an original document illumination lamp, etc., for illuminating an original document. The rotary developing unit comprises a yellow toner developing device 13Y, a magenta toner developing device 13M, a cyan toner developing device 13C, and a black toner developing device 13B. At the developing time, the developing device corresponding to the color of an electrostatic latent image rotates and moves to the photosensitive drum 10 for developing the electrostatic latent image with a predetermined toner. The transfer auxiliary corotron 14, which comprises a carrier removal roll 19, removes carriers contained in a toner image on the photosensitive drum 10, then performs transfer preprocessing so as to easily transfer the toner image.

On the other hand, the paper attraction paper 21 comes in contact with the transfer drum 20 only when recording paper P is supplied for attraction; otherwise, it is placed out of contact with the transfer drum 20. The paper attraction corotron 22, which comprises an attraction corotron wire 22*a,* causes recording paper P to be electrostatically attracted to the transfer drum 20 in conjunction with the paper attraction roll 21. The transfer corotron 15, which comprises a transfer corotron wire 15*a,* electrostatically transfers a toner image on the photosensitive drum 10 to recording paper P transported by the transfer drum 20.

The electricity removal drum 16, which includes an electricity removal corotron wire 16*a,* removes electricity so as to facilitate removal of remaining toner on the photosensitive drum 10 after a toner image is transferred from the drum. The cleaning unit 17, which includes a cleaning blade

17*a,* a cleaning aid brush 17*b,* a toner transport auger 17*c,* etc., scrapes off remaining toner on the photosensitive drum 10 by the blade 17*a,* sends the scraped-off toner via the aid brush 17*b* to the toner transport auger 17*c,* and finally sends the toner to a waste toner recovery bottle (not shown). After the photosensitive drum 10 is cleaned, it makes the transition to a toner image formation cycle of another color.

The paper stripping-off corotron 23 charges or removes electricity so that recording paper P to which the last-color toner image has been transferred is easily stripped off from the transfer drum 20. The paper stripping-off claw 24 comes in contact with the transfer drum 20 in a stripping-off step for stripping off recording paper P from the transfer drum 20. The electricity removal corotrons 25 are disposed in a pair facing each other with the dielectric film 20*a* of the transfer drum 20 between and comprise each an electricity removal corotron wire 25*a* for removing electricity of the dielectric film 20*a* from which recording paper P has been stripped off. The cleaning unit 26, which comprises a film cleaning brush 26*a* abutting the transfer drum 20 only when necessary, cleans the face of the dielectric film 20*a* whose electricity has been removed.

The fuser 30, to which recording paper P stripped off from the transfer drum 20 is sent, comprises a pair of fixing rolls 30*a* and fixes a transferred toner image onto the recording paper by heating, pressurizing, etc. The fixing rolls 30*a* are given fixing oil by fixing oil giving means (not shown) and are cleaned by a cleaning web (not shown).

The color copier uses a large number of parts which to be periodically replaced for the purposes of maintaining good copy image quality, etc. Table 1 lists the periodically replaced parts.

TABLE 1

| ID code | Name of periodically replaced part | Measurement Index | Life alarm value | Remarks |
|---|---|---|---|---|
| 001 | Photosensitive drum (1) | Number of revolutions of photo-sensitive drum | 200K revolutions | *1, 2, 3 |
| 002 | Discharge wire (11a) | Discharge time | 80 hours | *1, 2, 3 |
| 003 | Grid (11b) | Discharge time | 80 hours | *1, 2, 3 |
| 004 | Transfer corotron wire (15a) | Discharge time | 80 hours | *1, 2, 3 |
| 005 | Dielectric film (20a) | Number of revolutions of dielectric drum | 100K revolutions | *1, 2, 3 |
| 006 | Attraction corotron wire (22a) | Discharge time | 80 hours | *2, 3 |
| 007 | Electricity removal corotron wire (16a) | Discharge time | 80 hours | *1, 2, 3 |
| 008 | Electricity removal wire (25a) | Discharge time | 80 hours | *2, 3 |
| 009 | Film cleaning brush (26a) | Number of revolutions of dielectric drum | 200K revolutions | *2 |
| 010 | Cleaning corotron wire (16a) | Discharge time | 160 hours | *1, 2, 3 |
| 011 | Cleaning blade (17a) | Number of revolutions of photo-sensitive drum | 400K revolutions | *1, 2 |
| 012 | Cleaning aid brush (17b) | Number of revolutions of photo-sensitive drum | 400K revolutions | *1, 2 |
| 013 | Transfer auxiliary corotron wire (14a) | Discharge time | 80 hours | *1, 2 |
| 014 | Grid (14b) | Discharge time | 80 hours | *1, 2 |
| 015 | Developer (not shown) | Drive time of each develop-ing device | 100 hours each | — |
| 016 | Fixing roll (30a) | Number of copies | 100K copies | *2, 4 |
| 017 | Fixing oil (not shown) | Number of copies | 25K copies | *2 |
| 018 | Fixing roll cleaning web (not shown) | Number of copies | 50K copies | *2 |
| 019 | Paper transfer roll (not shown) | Number of copies | 100K copies | — |
| 020 | Original document illumination lamp (not shown) | Number of scan times | 500K times | *1 |
| 021 | Ozone filter (not shown) | Number of copies | 300K copies | *1, 2, 3 |

*1: Varies depending on the use ratio between color and monochrome copies
*2: Varies depending on the number of continuous copies of the same original document
*3: Varies depending on the use percentage of paper sizes
*4: Varies depending on the power ON time of the entire copier The color copier includes a detection and display unit for detecting and displaying the lives of periodically replaced parts as listed in Table 1.

Figure 2:
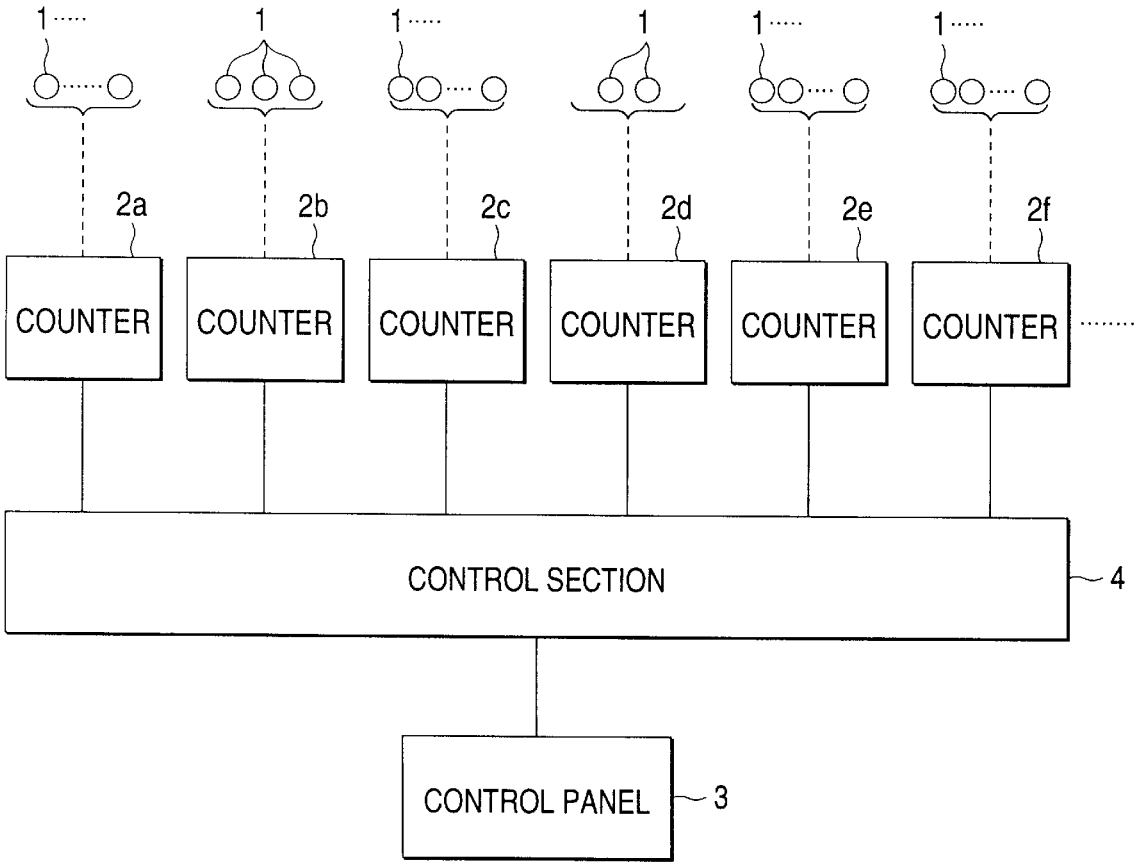
FIG. 2 is a block diagram showing a part life detection and display unit with which the color copier shown in FIG. 1 is provided.

FIG. 2 is a block diagram to show one example of the part life detection and display unit. In the figure, reference numeral 1 denotes various periodically replaced parts, reference numeral 2 is a counter as measurement means shown for each index for measuring the use results of the periodically replaced parts, reference numeral 3 is a control panel as display means for displaying various pieces of necessary information, and reference numeral 4 is a control section as detection and display control means for comparing the count cumulative value of each counter 2 with the life alarm value preset based on each index for each part 1 and displaying a replacement prompting message on the control panel 3 for prompting the operator to replace the part reaching the alarm value. For example, the control section 4 is configured as an arithmetic processing section comprising an input/output control section and memories.

In the detection and display unit, as listed in Table 1, the use result of each periodically replaced part is measured based on the optimum measurement index for the part and the life alarm values as life guidelines based on the indexes are preset.

As seen in Table 1, the lives of the periodically replaced parts cannot be measured according to the same index.

If the lives of the periodically replaced parts listed in Table 1 are all measured, for example, in terms of the number of copies, the life management based on the number of copies easily depends largely on the factors such as the use ratio between color and monochrome copies (*1), the number of continuous copies of the same original document (*2), the use percentage of paper sizes (*3), and the power ON time of the entire copier (*4). Thus, it is difficult to detect the lives of the periodically replaced parts according to the same index and replace the parts efficiently.

Then, with the detection and display unit, as shown in FIG. 3, the periodically replaced parts listed in Table 1 are classified into four part groups (packages) A–D each consisting of parts that can be replaced in batch at the same time and can be sorted according to the life term values in terms based on the number of copies. Package A has the life term value in terms of the number of copies set to 20,000 (=20K) copies and corresponds to the part group with the shortest life term value among packages A–D. Package B has the life term value set to 40,000 copies and package C has the life term value set to 80,000 copies. The life term values are set based on the life criterion, such that up to about 200K copies can be used when four continuous copies of A4-size paper (color copy use ratio 80%) are made.

For package D, whether or not the number of copies reaches the life alarm value, 300K is determined and life management is executed separately from other packages. Like package D, separate life management may be executed for some of the periodically replaced parts as required; all the periodically replaced parts may be distributed to packages A, B, and C for executing life management in package units.

The detection and display unit basically operates as follows:

First, each counter 2 measures the measurement index appropriate for each periodically replaced part. For example, the counter 2*a* measures the number of revolutions of the photosensitive drum 10, the counter 2*b* measures the number of revolutions of the dielectric (transfer) drum 20, the counter 2*c* measures the discharge time, the counter 2*d* measures the developing device drive time, the counter 2*e* measures the number of copies, and the counter 2*f* measures the number of times the original document reader has scanned.

Next, the detection and display control section 4 inputs and integrates the counts of the indexes measured by the counters 2 and determines whether or not the cumulative value (current value) exceeds the life alarm value of any of the periodically replaced parts. Whenever there is a periodically replaced part whose life alarm value is exceeded, the detection and display control section 4 instructs the control panel 3 to display replacement prompting messages of the part and the package containing the part.

The parts in the package prompted to be replaced in the message are all replaced at a time. That is, the parts in the package not reaching their life alarm values are replaced at the same time without exception. The parts in the same package are thus replaced at the same time in batch, thereby eliminating a complicated procedure wherein each time the parts having a high possibility of reaching the life alarm value in a short time reach the lives one after another, they must be replaced separately. The parts contained in the same package are grouped according to the criterion that they can be attached or detached in relation to each other efficiently, whereby replacement work can be made more efficient.

Upon completion of replacement of all parts in the package, only the counters for measuring the indexes of the replaced parts are reset to zero by reset means (not shown).

When a part reaches the life alarm value, the detection and display control section 4 compares the number of times package A having the shortest life term value is replaced with the value of an integer multiple of the life term value of package A relative to each of the life term values of other packages B and C (two or four where the life term value of package A is assumed to be one) for determining whether or not both values match. The control operation of replacement prompting message display varies depending on whether or not the part reaching its life alarm value is contained in package A having the shortest life term value.

Figure 4:
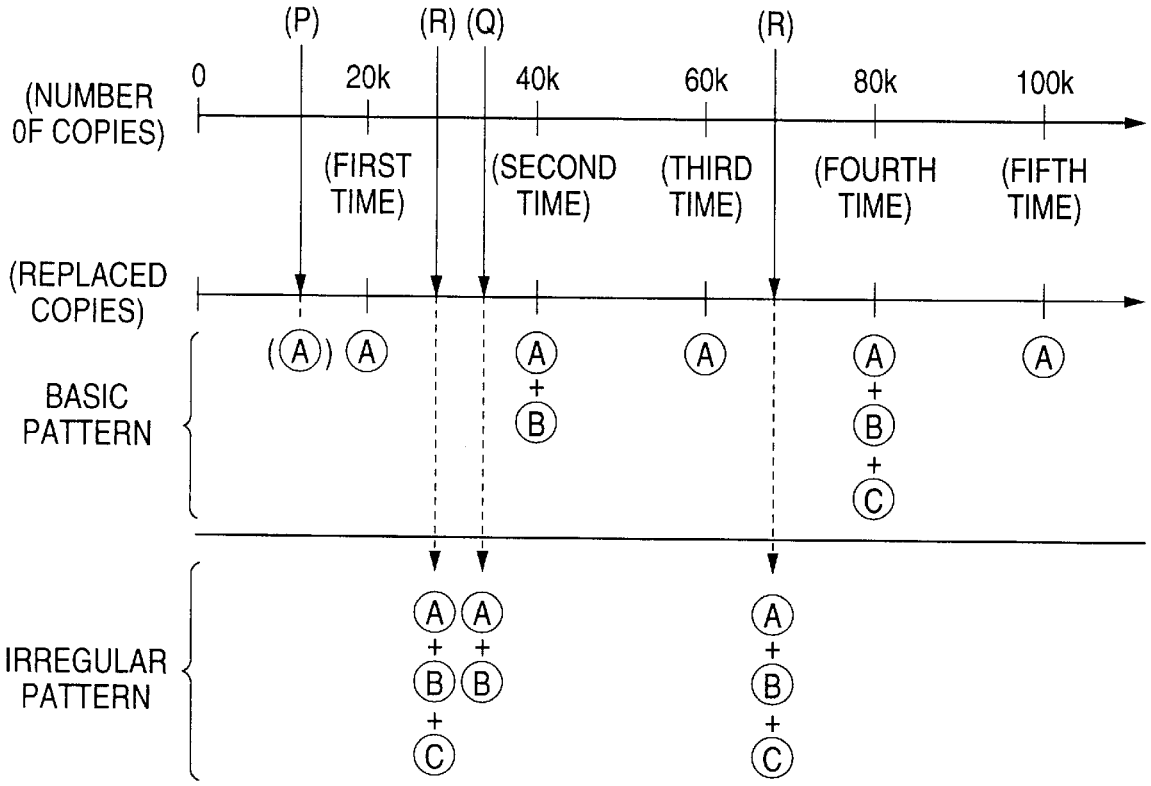
FIG. 4 is an illustration showing the operation timing of the detection and display unit.

That is, assuming that the number of times package A having the shortest life term value is replaced (time) matches the time reaching its life term value (20K in terms of the number of copies), replacement prompting messages are displayed as illustrated in FIG. 4 as "basic pattern." If the part reaching its life alarm value is contained in package A, when the number of times package A is replaced does not match any values of the integer multiples of the life term value of package A relative to the life alarm values of other packages B and C where the life term value of package A is assumed to be one (the number of times package A is replaced is one, three, or five), only a replacement prompting message of package A is displayed. When the number of times package A is replaced matches the value of the integer multiple (when the number of times package A is replaced is two, the value of the integer multiple is two or when the number of times package A is replaced is four, the value of the integer multiple is four), replacement prompting messages of package A and the package corresponding to the value of the integer multiple matched are displayed at the same time. That is, when the number of times package A is replaced is two, replacement prompting messages of packages A and B are displayed; when the number of times package A is replaced is four, replacement prompting messages of packages A, B, and C are displayed.

If any part in package A reaches its life alarm value before the number of copies becomes 20K (P point in time in FIG. 4), a replacement prompting message of package A is displayed, of course.

On the other hand, if the part reaching its life alarm value is contained in any other package than package A, replacement prompting messages are displayed as illustrated in FIG. 4 as "irregular pattern". That is, replacement prompting messages of the package containing the part reaching its life alarm value and the package having the life term value set shorter than that of that package are displayed at the same time. That is, if a part in package B reaches its life alarm value before the number of copies becomes 40K (Q point in time in FIG. 4), replacement prompting messages of packages A and B are displayed; if a part in package C reaches its life alarm value before the number of copies becomes 80K (R point in time in FIG. 4), replacement prompting messages of packages A, B, and C are displayed.

Lift management for packages B and C other than package A having the shortest life term value is executed as described above after the number of times package A is replaced is compared with the value of the integer multiple of the life term value of package A relative to each of the life term values of packages B and C (where the life term value of package A is assumed to be one), whereby life management can be executed more efficiently and easily. Moreover, in any case, the part life is detected and displayed so that parts are replaced in package units, so that a work mistake of forgetting to replace parts is hard to occur. At the same time as the life management is executed in package units, life management as to whether or not each part in packages B and C reaches the life alarm value is also executed, needless to say. A replacement prompting message as in the irregular pattern shown above may be displayed as a result of such concurrent life management execution.

A specific example of executing life management of the parts contained in packages A and B in package units as described above will be discussed.

Figure 5:
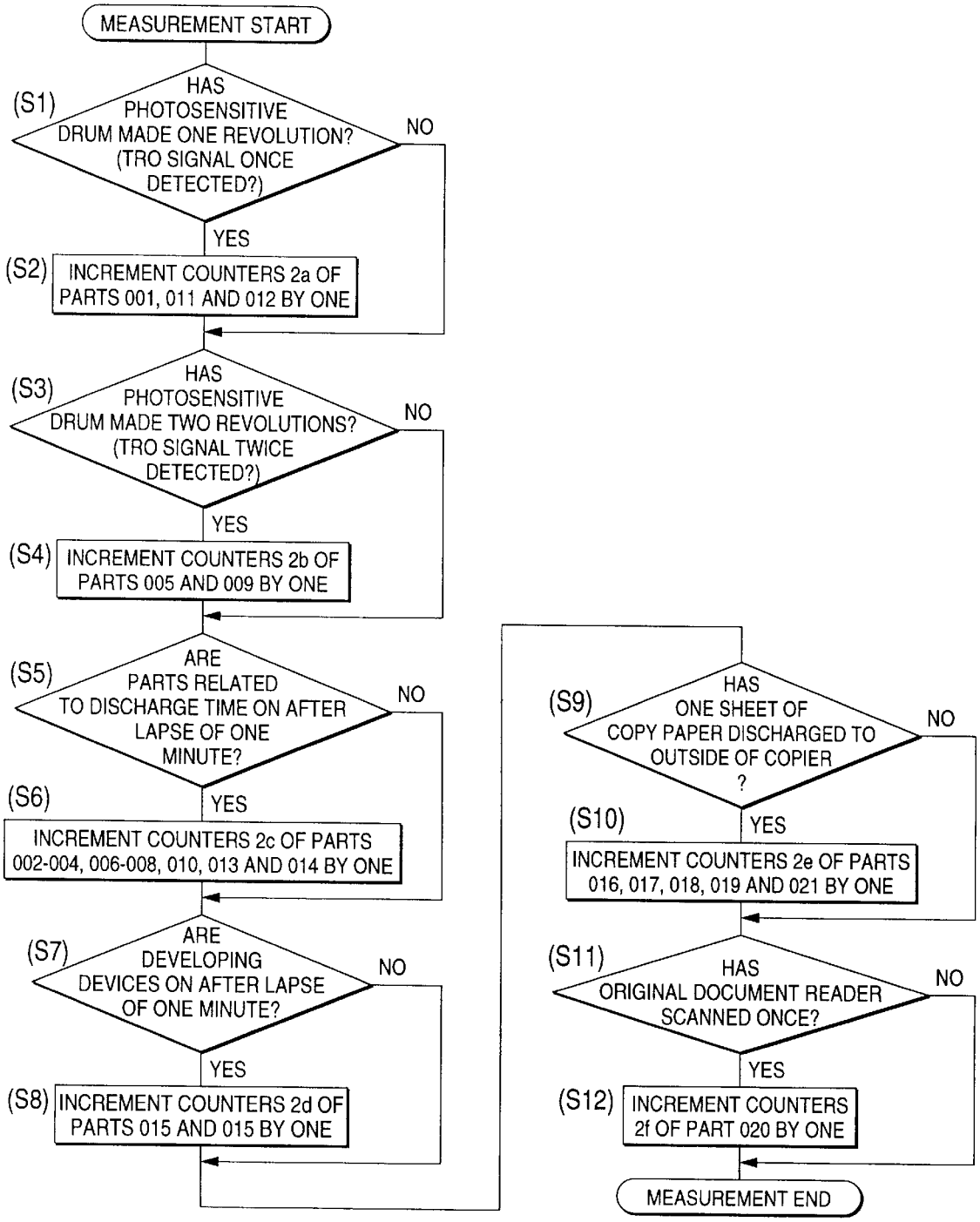
FIG. 5 is a flowchart showing a measurement process of the detection and display unit.

First, the indexes are measured by executing steps as shown in a flowchart of FIG. 5.

That is, whether or not the photosensitive drum has made one revolution (for example, a TRO signal detected by one revolution of the drum has been once detected) is determined at step S1. If the photosensitive drum has made one revolution, the counters 2*a* of the parts with the number of revolutions of the photosensitive drum as the index are incremented by one at step S2. If one revolution of the photosensitive drum is not detected, control goes to the next detection step. Next, whether or not the photosensitive drum has made two revolutions (for example, a TRO signal detected by one revolution of the drum has been twice detected) is determined at step S3. If the photosensitive drum has made two revolutions, the counters 2*b* of the parts with the number of revolutions of the photosensitive drum as the index are incremented by one at step S4. Next, real-time detection is executed for one minute and whether or not the parts related to the discharge time, such as the discharge wire and grid, are on (energized) after a lapse of one minute is determined at step S5. If the parts related to the discharge time are on (energized), the counters 2*c* of the parts with the discharge time as the index are incremented by one at step S6. Next, real-time detection is executed for one minute and whether or not the developing devices are on (energized) after a lapse of one minute is determined at step S7. If the developing devices are on (energized), the counters 2*d* of the parts with the developing device drive time as the index are incremented by one at step S8. Next, whether or not one sheet of copy paper has been discharged to the outside of the copier is determined at step S9. If one sheet of copy paper has been discharged to the outside, the counters 2*e* of the parts with the number of copies as the index are incremented by one at step S10. Last, whether or not the original document reader has scanned once (read scan) is determined at step S1. If the original document reader has scanned once, the counters 2*f* of the parts with the number of scan times as the index are incremented by one at step S12.

Measurement of the index is now complete.

Figure 6:
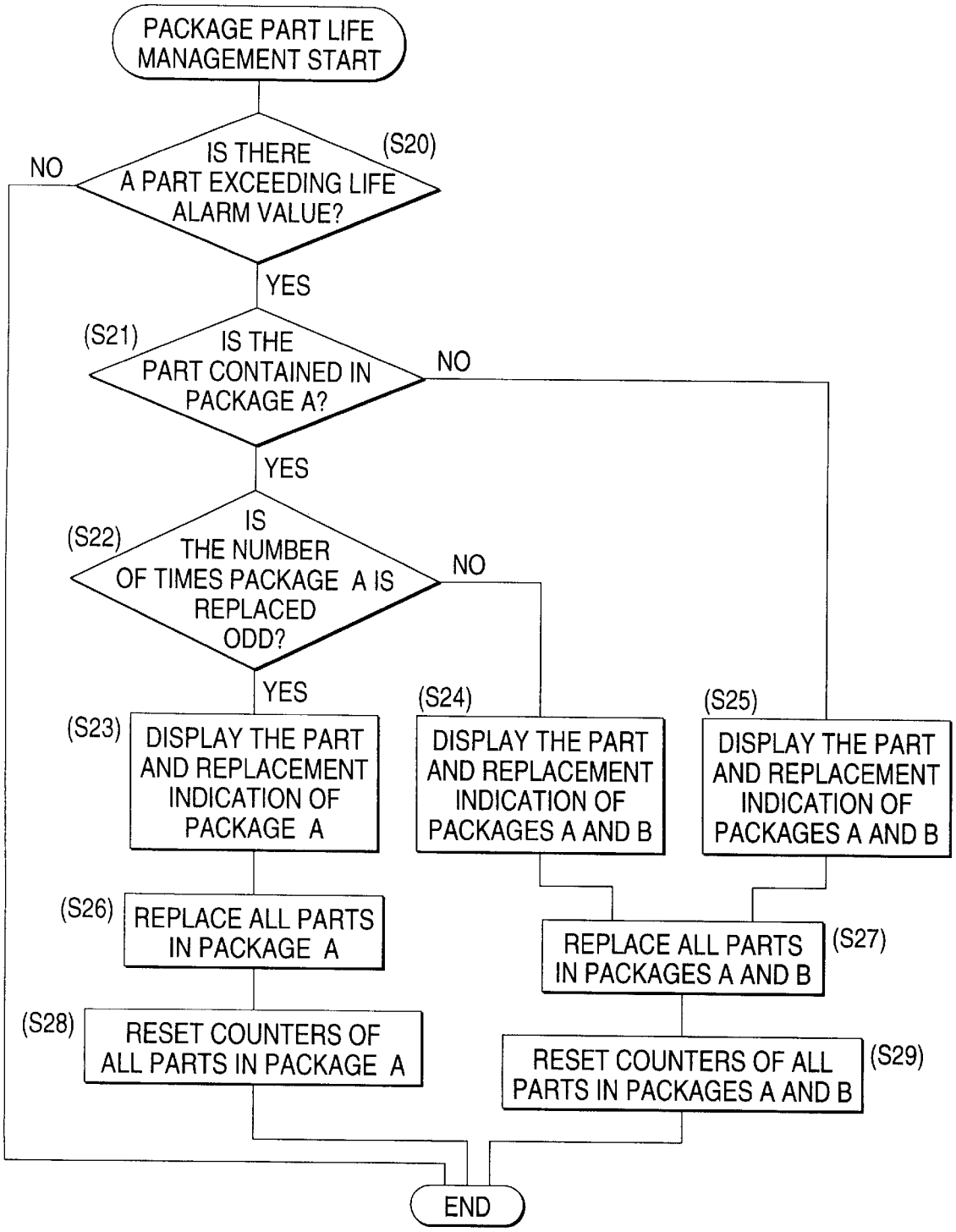
FIG. 6 is a flowchart showing a detection and display process of the detection and display unit.

Using the cumulative measurement values of the indexes, steps as shown in a flowchart of FIG. 6 are performed for execution of life management for packages A and B.

That is, the control section 4 determines whether or not the cumulative value of each index measured (current life value) exceeds the life alarm value of any part at step 20. If the cumulative values do not exceed the life alarm values, the process is terminated. If the cumulative value exceeds the life alarm value of one part, the control section 4 determines whether or not the part is contained in package A at step S21.

If the part is contained in package A at step S21, the control section 4 determines whether or not the number of times package A is replaced is odd at step S22. This determination at step S21 corresponds to the determination as to whether or not the number of times package A is replaced matches the value of an integer multiple of the life term value of package A relative to the life alarm value of package B where the life term value of package A is assumed to be one. If the number of times package A is replaced is determined to be odd at step S22, replacement prompting messages of the part reaching the life alarm value and package A itself are displayed on the control panel 3 at step S23, as illustrated in FIG. 4. In contrast, if the number of times package A is replaced is determined to be even, the parts in package B with the life term value set twice that of package A are also assumed to reach "part life" and replacement prompting messages of the part reaching the life alarm value and packages A and B are displayed on the control panel 3 at step S24.

On the other hand, if the part is not contained in package A at step S21, replacement prompting messages of the part reaching the life alarm value and package A in addition to package B are displayed at the same time on the control panel 3 at step S25.

The display form on the control panel 3 is not limited; for example, the display format as illustrated in FIG. 7 can be adopted.

That is, the type of periodically replaced part (identification code or part name), the current life (cumulative value), and Spec Life (life measurement value) for each package are displayed on the control panel 3. In fact, the contents shown in FIG. 7 cannot be displayed at a time because the contents that can be displayed on the control panel 3 are limited. However, all the contents can be displayed, for example, by a scroll function for moving the screen. L in FIG. 7 denotes the display area width, which allows fields for 10 parts to be displayed at a time.

Assuming that a part in package B (identification code 009: Film cleaning brush 26*a*) reaches the life alarm value in the display format, the fields for the part and the columns of packages A and B are blink-displayed, as shown in FIG. 8, at step S25. This corresponds to the display contents at point Q in FIG. 4, for example. The display method is not limited to the blink display; an alternative method may be adopted. For example, the text and background portions are reverse-displayed or to use a color display, can be displayed in a color different from the normal one.

If part replacement is not executed after the display in FIG. 8 is produced and the copy operation is continued for a while, parts (for example, those with identification codes 002 and 018) may reach the life alarm values meanwhile. In this case, as shown in FIG. 9, the fields for new parts reaching the life alarm values are blink-displayed in addition to the reverse display of the portions shown in FIG. 8.

When such replacement prompting display is produced, all parts contained in the displayed packages are replaced in batch at the same time. That is, if the display at step S23 is produced, all parts in package A are replaced at step S26; if the display at step S24 or S25 is produced, all parts in packages A and B are replaced at step S27.

After the parts are replaced, counters 2 of all replaced parts are reset to zero. That is, if all parts in package A are replaced, the counters of all parts in package A are reset at step S28; if all parts in packages A and B are replaced, the counters of all parts in packages A and B are reset at step S29.

As we have discussed, according to the invention, the life of each periodically replaced part is detected and displayed separately based on the life alarm value and in addition, the part lives are detected and displayed in units of periodically replaced part groups each consisting of parts that are almost the same in life term value and can be replaced in batch at the same time, and all parts in the part group containing the part reaching the life alarm value are replaced at the same time. Thus, if the life arrival time of each part depends greatly on the use mode of the copier, life management of a large number of periodically replaced parts can be executed easily; moreover, replacement work of the parts to be replaced can be performed efficiently and reliably without forgetting to replace the parts.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A part life detection and display unit comprising:

measurement means for respectively measuring and accumulating use results for each of a large number of periodically replaced parts in an image formation system based on indexes respectively appropriate to measure actual use for each said periodically replaced parts;

means for displaying predetermined information;

means for storing life alarm values preset on the basis of each of said indexes for each of said large number of said periodically replaced parts, wherein each said life alarm value corresponds to one of a plurality of parts that are classified into a respective part groups, so that parts that can be replaced in batch at the same time and can be sorted on the basis of life term values converted based on a same index, and so that said life term values of part groups other than specified part groups having the shortest life term value among said plurality of part groups are set to an integer multiple of said shortest life term value;

means for resetting a cumulative value of said measurement means related to a part to zero upon completion of replacement of said part;

detecting-displaying-controlling means for detecting whether there are said periodically replaced parts having reached said life alarm value when said use results accumulated by said measurement means for each of said periodically replaced parts is compared with said life alarm values stored by said storing means, displaying a replacing direction for a specified periodically replaced part group having the shortest life term value when said periodically replaced part having reached said life alarm value exists in said specified part group having the shortest life term value, and if a replaced number of said periodically replaced part reaching its life alarm value is not equal to an integer multiple of the life term of other groups, displaying a replacing direction for said specified part group having the shortest life term value and other periodically replaced part groups for which the replaced number of said periodically replaced part is equal to an integer multiple of said shortest life term value, if the replaced number of said periodically replaced part is equal to a value of an integer multiple of the life term value of the other groups, and said periodically replaced part having reached said life alarm value exists in said specified part group having the shortest life term value, and displaying said replacing direction for said specified part group having the shortest life term value and other specified part groups having said life term values being shorter than a specified life term value, when a periodically replaced part having reached a specified life alarm value exists in part groups other than said specified part group having the shortest life term value.

2. The part life detection and display unit as claimed in claim 1 wherein when the number of times the part group having the shortest life term value is replaced matches the value of the integer multiple, replacement prompting indications of the part group having the shortest life term value and the part group corresponding to the value of the integer multiple matched are displayed at the same time.

3. The part life detection and display unit as claimed in claim 1 wherein if the periodically replaced part reaching its life alarm value exists in any other part group than the part group having the shortest life term value, replacement prompting indications of the part group containing the part reaching the life alarm value and the part group having the life term Value set shorter than that of that part group are displayed at the same time.

* * * * *